US007520794B1

(12) United States Patent
Johnson

(10) Patent No.: US 7,520,794 B1
(45) Date of Patent: Apr. 21, 2009

(54) STRAPLESS, BACKLESS CAMISOLE GARMENT

(76) Inventor: Julie A. Johnson, 2345 Jakes Pl. NE., Moses Lake, WA (US) 98837

( * ) Notice: Subject to any disclaimer, the term of this patent is extended or adjusted under 35 U.S.C. 154(b) by 0 days.

(21) Appl. No.: 12/038,436

(22) Filed: Feb. 27, 2008

(51) Int. Cl.
*A41D 3/00* (2006.01)
*A41B 1/00* (2006.01)

(52) U.S. Cl. ..... 450/1; 2/106; 2/49.1; 2/109

(58) Field of Classification Search ..... 450/1, 450/28, 30–33, 80; 2/69, 46, 49.1–49.4, 2/67, 102–106, 109, 73, 115, 113, 144, 145, 2/51

See application file for complete search history.

(56) References Cited

U.S. PATENT DOCUMENTS 731,759 A * 6/1903 Dieter ..... 2/48
2,567,524 A * 9/1951 Morganti ..... 2/48
2,707,786 A * 5/1955 Stoner ..... 2/119
7,188,372 B2 * 3/2007 Stockard ..... 2/104
7,409,728 B2 * 8/2008 Harry ..... 2/106

* cited by examiner

*Primary Examiner*—Gloria Hale
(74) *Attorney, Agent, or Firm*—Wells St. John P.S.

(57) ABSTRACT

A garment including a panel comprising a first and a second layer of fabric. The panel has a front and a back, a first outermost corner disposed at a junction between a first upper side seam and a first lower side seem, and a second outermost corner disposed at a junction between a second upper side seam and a second lower side seam. An article of clothing comprising a fabric panel having a top, a bottom, a left side, a right side, a front and a back. The article has six seams. There are six corners, each of the corners being disposed at a junction between two of the six seams, and a plurality of attachment devices disposed on the back of the garment. A garment consisting of a front layer of fabric, a back layer, six seams, six corners and six attachment devices disposed on the back side.

22 Claims, 4 Drawing Sheets

STRAPLESS, BACKLESS CAMISOLE GARMENT

TECHNICAL FIELD

The invention pertains to a strapless, backless camisole type article of clothing.

BACKGROUND OF THE INVENTION

Many modern fashionable tops, blouses, sweaters, shirts, dresses etc. are styled with a low cut neckline which leaves a portion of a woman's breasts exposed. However, these low cut fashions can seem inappropriate in many social situations and business or work settings. Additionally, some women may feel uncomfortable and/or embarrassed having an exposed cleavage area.

One alternative is to wear a second garment beneath the low cut fashion. Wearing a second top, for instance, beneath a low cut fashion can be bulky and/or constrictive and uncomfortable. Such can also interfere with the lay of the fabric of the low cut fashion. A second option is to wear a conventional corset type garment. However, a corset typically has straps which leave the set of straps to contend with. Straps can slip while wearing; can show along the neck line of a garment and/or the sleeve side of a garment (sleeveless). Further, straps may be visible through the garment and/or leave visible strap lines. Additionally, conventional corsets have a back which can leave indentations in the body visible through the overlying garment and/or may leave seam lines visible through the garment.

It is desirable to develop alternative garments for wearing under low cut fashions.

SUMMARY OF THE INVENTION

In one aspect the invention pertains to a garment of clothing including a panel comprising a first layer of a first fabric and a second layer of a second fabric, the panel has a front face and an opposing back face. The panel has a first upper side seam along a first side of the garment and a first lower side seem along the first side of the garment. The panel further has a first outermost corner disposed at a junction between the first upper side seam and the first lower side seam. The panel also includes a second upper side seam along the second side of the garment, a second lower side seam along the second side of the garment and a second outermost corner disposed at a junction between the second upper side seam and the second lower side seam.

In one aspect the invention includes an article of clothing comprising a fabric panel having a top, a bottom, a left side, a right side, a front face and a back face. The article of clothing has six seams consisting of a top seam, a bottom seam, two left side seams and two right side seams. There are six corners, each of the corners being disposed at a junction between two of the six seams and a plurality of attachment devices disposed on the back face of the garment, enclosed within the garment or on the front face of the garment.

In one aspect the invention includes a garment consisting of a front layer of fabric disposed on a front side, a back layer of fabric disposed on a back side, a top seam, a bottom seam, a first upper side seam, a first lower side seam, a second upper side seam, a second lower side seam, six corners and six attachment devices disposed on the back side.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The present invention generally includes strapless, backless, corset type garments. The garments are developed to wear under low cut fashions such as tops, blouses, sweaters, dresses etc. The articles of clothing of the invention are configured to attach to a bra, camisole, skin, slip, etc., and lay across the front of the wearer to cover a cleavage area that would otherwise be exposed while wearing the low cut fashion in the absence of the garment of the invention.

Many women attend social settings, business, or work settings where exposed cleavage would make themselves or those around them uncomfortable, or would just seem inappropriate. However, in other settings, fashions that expose such area are commonly worn and appropriate. The article of clothing of the invention is configured to attach and detach to be quickly removable upon going from one setting to another. Further, the garment is so small that a person may carry more than one with them and switch from one to another to change color, fabric etc. during a day. The garment of the invention can advantageously allow low cut fashions to be worn in places that they would otherwise seem inappropriate. Another advantage of the garment of the invention is that such can be worn by persons having scarring from breast surgery, allowing them to wear low cut fashions which they may otherwise choose not to wear.

Figure 1:
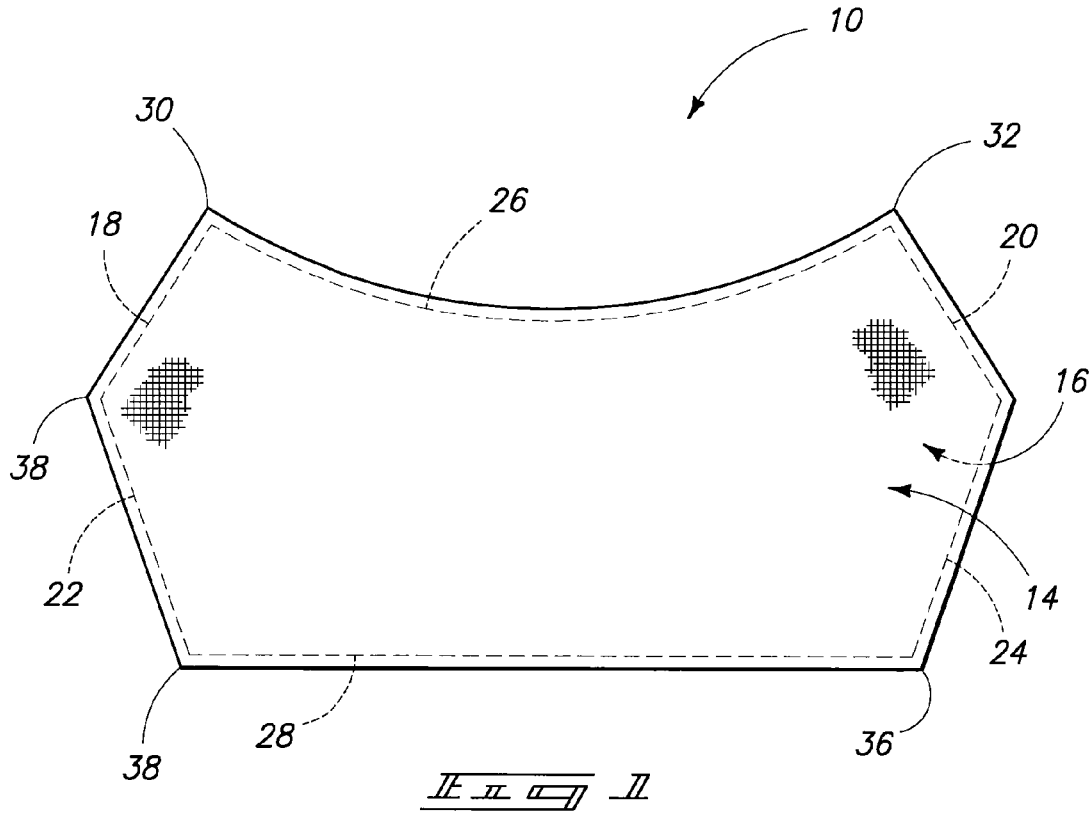
FIG. 1 is a diagrammatic front view of an article of clothing in accordance with one aspect of the invention.

Exemplary aspects of the invention are described generally with reference to FIGS. 1-6. Referring initially to FIG. 1, an exemplary garment 10 is show viewed from a front side. Garment 10 can comprise a panel 12 having a front face 14 and an opposing back face 16. Garment 10 can have a first upper side seam 18 along a first side of the garment and a second upper side seam 20 along a second side of the garment. Garment 10 can further have a first lower side seam 22 along the first side of the garment and a second lower side seam 24 along the second side of the garment. Garment 10 additionally has a top seam 26 and a bottom seam 28.

Panel 12 can be shaped as shown in FIG. 1. The relative lengths of the upper to lower side seams are not limited to a particular value. However, it can be preferable that lower side seams 22 and 24 be longer than upper side seams 18 and 20 for a proper fit. Typically side seams 22 and 24 and edges and bottom seam 28 and corresponding edge will be straight. In contrast, top seam 26, and the corresponding edge can be curved as shown or can be straight (not shown). The curvature of seams 26, is not limited to a particular value so long as the garment retains its function to cover the cleavage area. Side seams 18 and 20 can be straight as depicted in FIG. 1 or can be curved (not shown). The curvature of seams 18 and 20 is not limited to a particular value.

The seams of garment 10 are described as being six independent seams 18, 20, 22, 24, 26 and 28. It is to be understood however, that one or more of such seams can be comprised by one or more continuous seams and can be considered as segments of such continuous seam(s). It is also to be understood that the depicted seams are for illustration purposes only and are placed in the general location of the seams of an actual garment in accordance with the invention. For example, for a double layer panel (discussed below) the six seams may actually be along the edge of the garment.

As shown in FIG. 1, garment 10 has six corners 30, 32, 34, 36, 38 and 40. Such corners can be described as comprising four inner corners 30, 32, 34 and 36 and two outermost corners 38 and 40. Outermost corner 38 can be described as being disposed at or proximate a junction between seam 18 and 22. Similarly, outermost corner 40 can be described as being at or proximate a junction between seam 20 and seam 24. Similarly, inner corner 30 can be described as being at or proximate a junction between seam 18 and seam 26 and corner 32 can be described as being at or proximate a junction between seam 26 and seam 20. Corner 34 can be described as being disposed at or proximate a junction between seam 22 and seam 28, inner corner 36 can be described as being disposed at or proximate a junction between seam 24 and seam 28.

In particular instances, panel 12 can comprise a single layer of fabric. Such fabric can be non-stretchable, can be stretchable in one direction, or can be stretchable in two directions. Exemplary fabrics which can be utilized for panel 12 include, but are not limited to, silk, cotton, linen, wool, worsted, spandex, rayon, polyester and lace. Such fabric can be plain, designed or embellished with, but not limited to, applica, metals, plastics, acrylics or other fabrics.

It is further noted that stretch may be provided to garment 10 by providing elasticity at the seams. Elasticity may be provided at one or more of seams 18, 20, 22, 24, 26 and 28. In particular applications, elasticity will be provided at, for example, lower side seams 22 and 24. Such elasticity can be provided by methods including but not limited to providing a elastic strip along the seams or by utilizing elastic thread.

Figure 2:
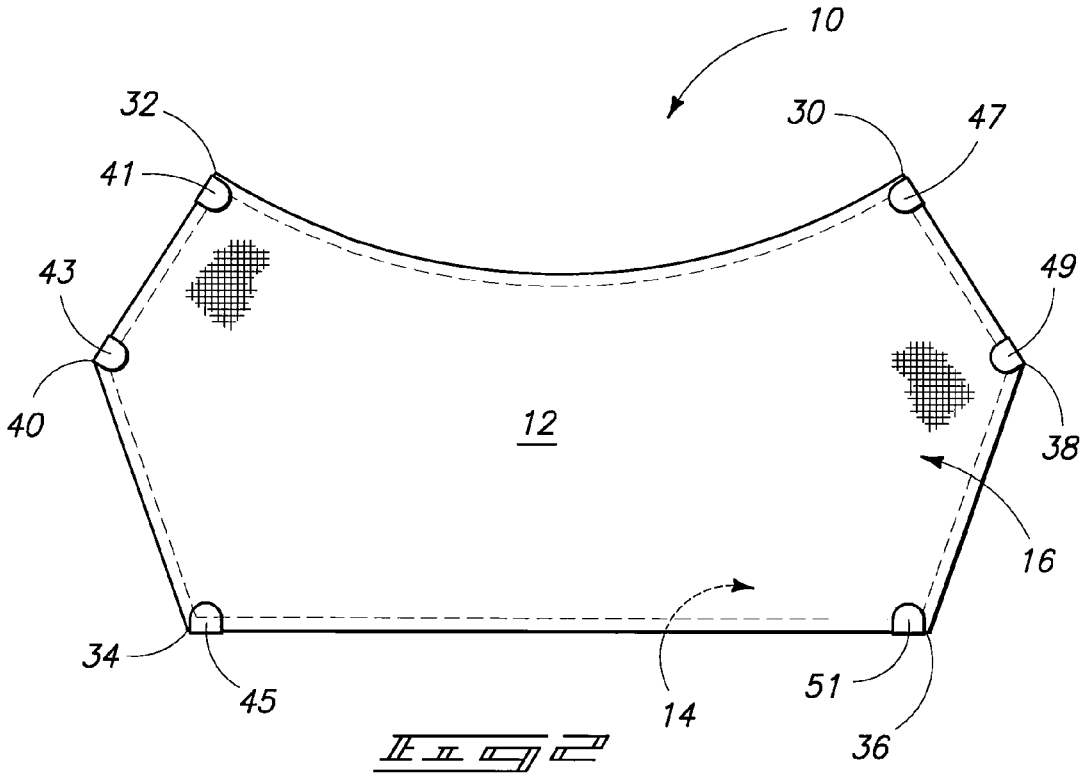
FIG. 2 is a back view of an article of clothing in accordance with one aspect of the invention.

Referring to FIG. 2, such shows garment 10 depicted in FIG. 1 viewed from back side 16 of panel 12. Garment 10 can have a plurality of attachment devices 41, 43, 45, 47, 49 and 51 disposed on back side 16. Although FIG. 2 depicts six of such attachment devices, it is to be understood that the invention contemplates utilizing fewer or more than six attachment devices. For example, garment 10 can comprise from two to ten attachment devices.

As depicted in FIG. 2, attachment devices 41 and 45 and attachment devices 30 and 51 are disposed proximate corresponding inner corners 32 and 34 and inner corners 30 and 36. Similarly, attachment devices 43 and 49 are disposed proximate outermost corners 40 and 38 respectively.

As depicted, each of attachment devices 41 through 51 are hook type attachment devices. It is to be understood however, that one or more of the attachment devices present may differ from others present on garment 10. Further, the attachment devices are not limited to a particular type of attachment device. Exemplary types of attachment devices which can be utilized in accordance with the invention include, but are not limited to, clips, clasps, snaps, magnets, adhesive elastics, hooks, buttons, hook and loop fastener material such as VELCRO® (Velcro Industries, Netherlands), and combinations thereof.

Figure 3:
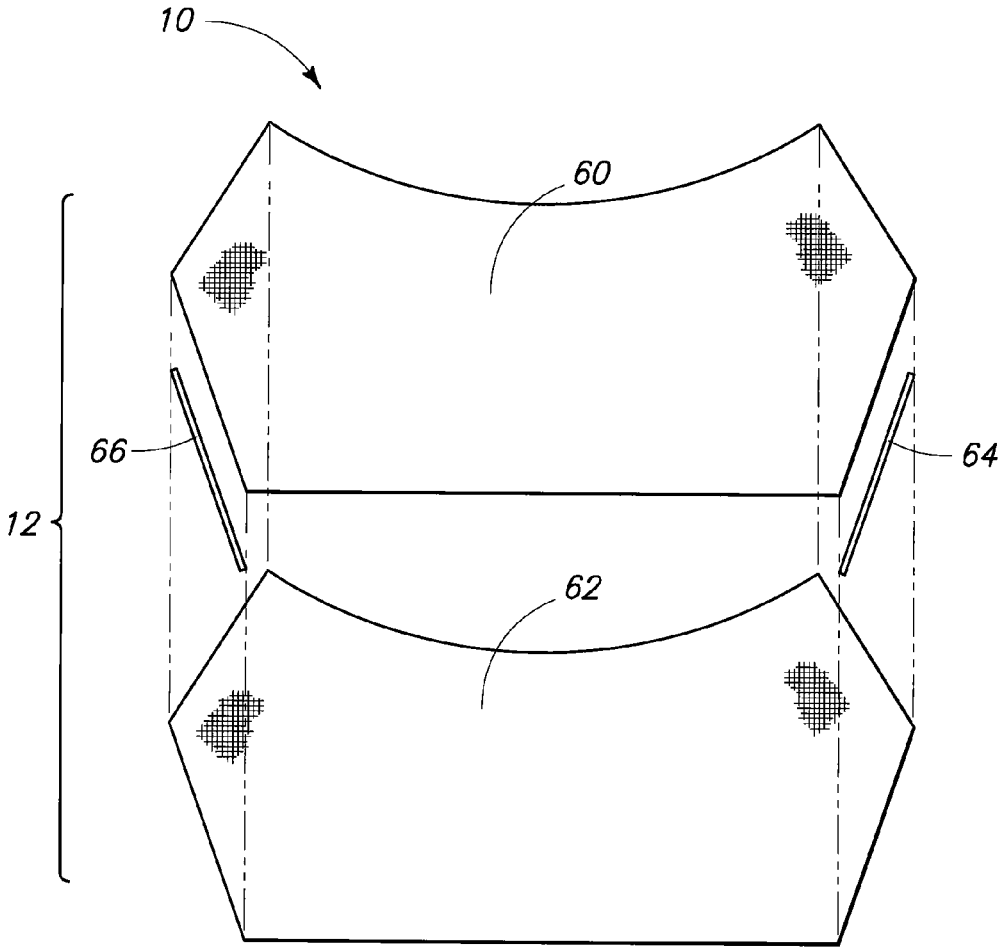
FIG. 3 is an exploded view of an article of clothing in accordance with one aspect of the invention.

Referring next to FIG. 3, such shows an embodiment of the invention wherein garment 10 has a single panel 12 comprising a first layer of fabric 60 and a second layer of fabric 62. The two layers of fabric can be of the same fabric or can be of differing fabrics. Fabrics which can be utilized for either of the two layers can be those exemplary fabrics discussed above.

Figure 4:
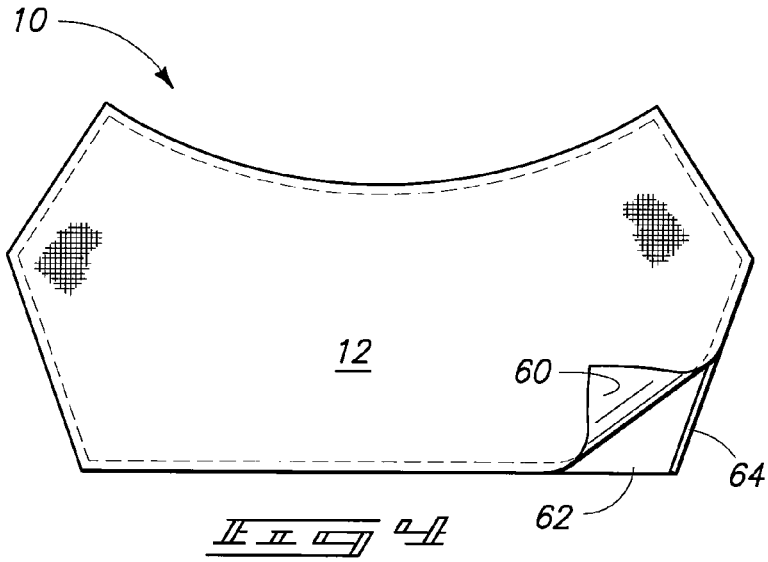
FIG. 4 is a top view of an article of clothing in accordance with one aspect of the invention.

In particular aspects, elastic can be incorporated between two or more edges of the fabrics where the six seams will eventually be formed. For example, elastic strips 64 and 66 can be incorporated between the lower side edges of fabric 60 and 62. Elasticity can alternatively be provided utilizing elastic thread. Alternative elastic placement and embodiments which do not incorporate elastic are not shown. FIG. 4 shows the garment 10 of FIG. 3 having panel 12 incorporating fabric 60 and fabric 62 with elastic 66 and 64 along the lower side seams. The approximate positions of the six seams are depicted. It is to be noted that the seams of double layered panel 12 are likely to be within the panel such that the seam does not appear on the external side of such panel. However, the invention contemplates embodiments where one or more external seams appear on double layered panel 12.

Panel 12 of FIG. 4 can have, for example, six attachment devices incorporated on the back side of the panel such as those depicted in FIG. 2. Alternatively, panel 12 can have fewer or more than six attachment devices incorporated thereon. In an alternative embodiment, a plurality of attachment devices can be provided between the two layers of fabric such that the devices are internal relative to the garment. Attachment of the garment will include attachment through one of the two layers of fabric.

In particular embodiments, a garment of the invention can be described as consisting of a front layer of fabric, a back layer of fabric, six seams, six corners and a plurality of attachment devices disposed on the back side.

Figure 5:
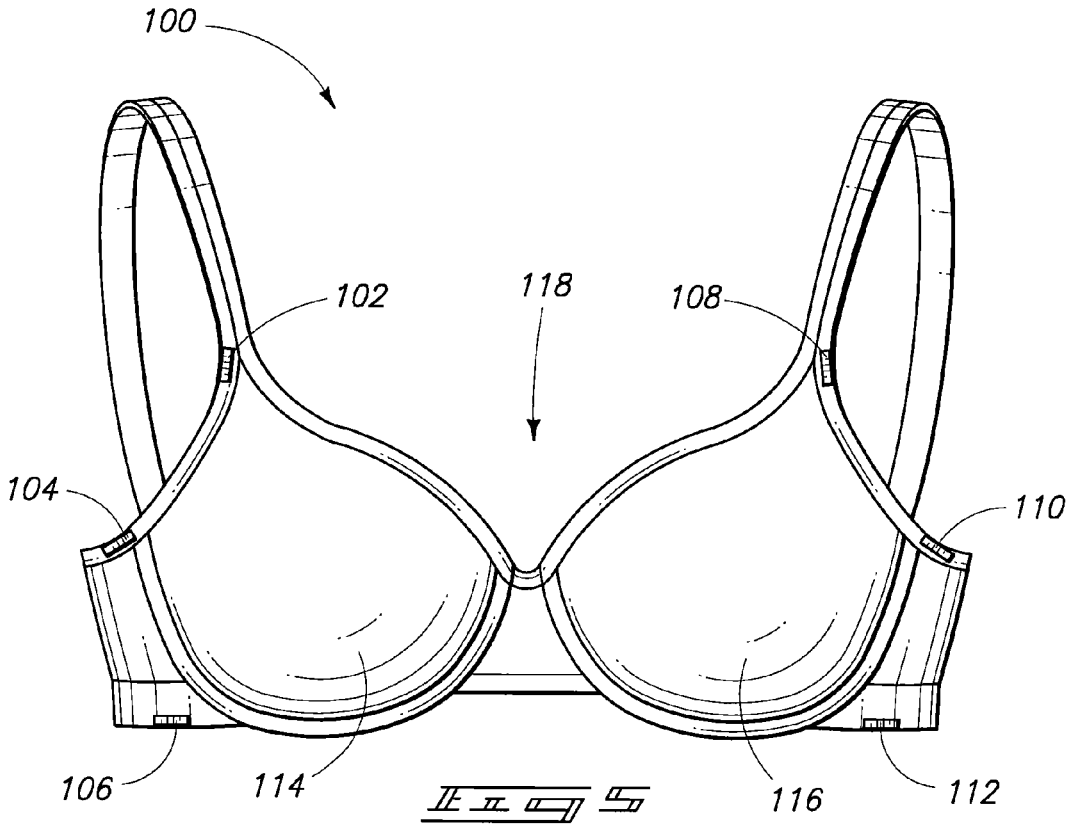
FIG. 5 is a front view of a bra showing attachment points for an article of clothing in accordance with one aspect of the invention.

Garments in accordance with the invention are configured for attachment to, for example, bras, slips, camisoles, outer garments or skin utilizing the appropriate attachment device, type and configuration. Referring to FIG. 5, such shows a bra 100 which can be utilized for attachment of a garment in accordance with the invention. Bra 100 has cups 114 and 116 with an exposed area 118 there between. Indicated in FIG. 5 are attachment sites 102, 104, 106, 108, 110 and 112 where six attachment devices can attach, corresponding to the six attachment devices disposed on the backside of a garment in accordance with an embodiment of the invention having a six attachment device configuration.

Figure 6:
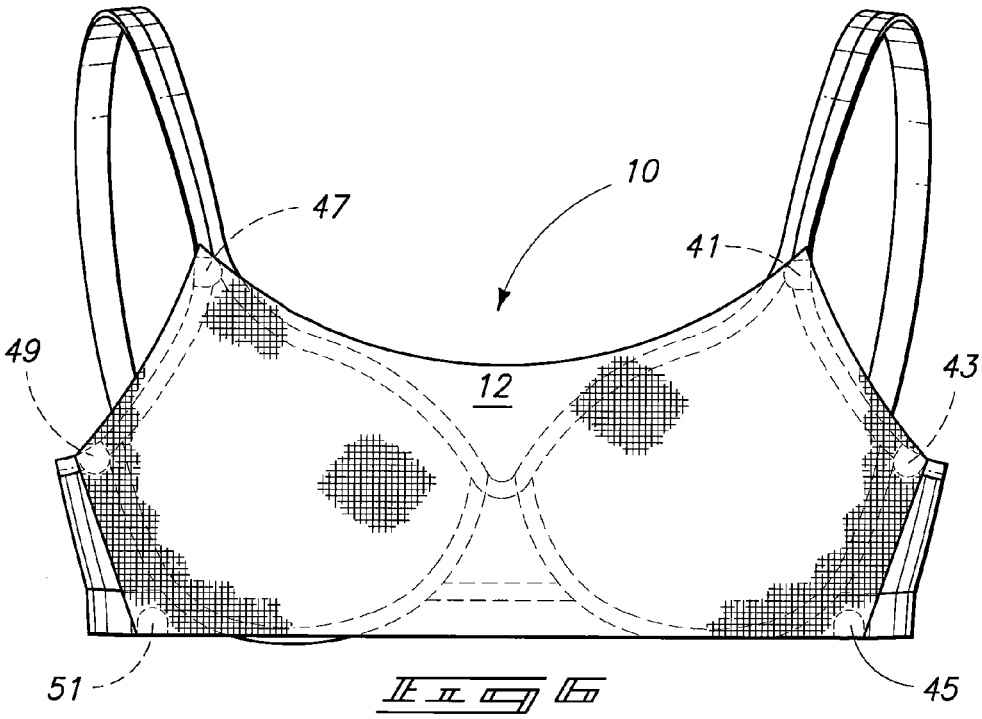
FIG. 6 is a front view of an article of clothing attached to a bra in accordance with one aspect of the invention.

Referring to FIG. 6, a garment 10 in accordance with the invention is shown overlaying a portion of bra 100. As indicated, attachment devices 47, 49, 51, 41, 43 and 45 are attached to bra 100 at the depicted attachment sites. Such attachment allows panel 12 to cover cup portions for 114 and 116 along with the previously exposed area 118 (shown in FIG. 5). Thus, the article of clothing in accordance with the invention can cover an otherwise exposed cleavage area without utilization of straps or a back.

Figure 7:
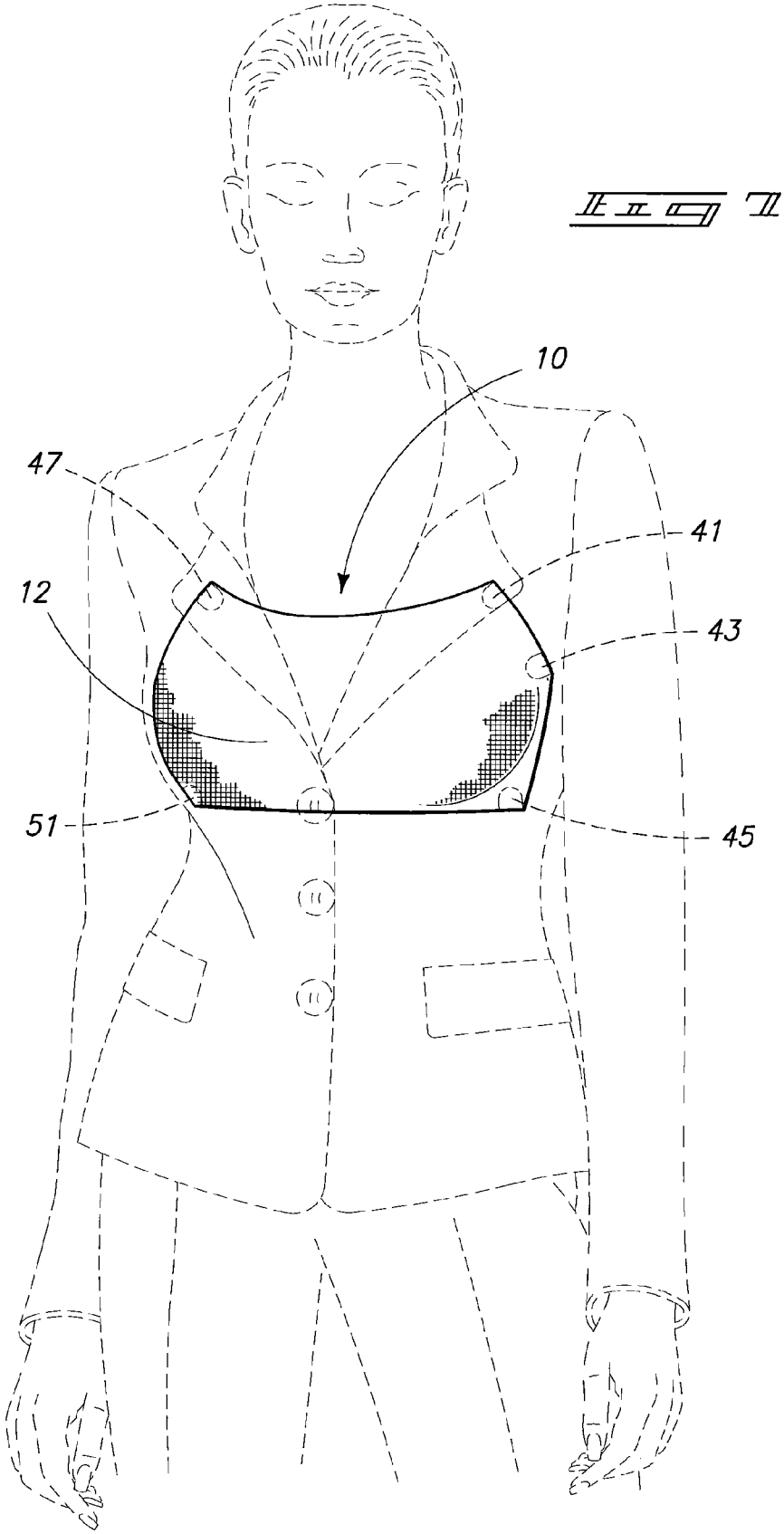
FIG. 7 is a front view of a diagrammatic model wearing an article of clothing in accordance with the invention.

Referring to FIG. 7, such depicts a garment in accordance with the invention as worn by a diagrammatic model. As shown, garment 10 can cover the cleavage area of the wearer when worn under a low-cut neckline outer garment. Garment 10 can be removed easily without the need to remove the outer garment simply by undoing the attachment devices and slipping garment 10 out through the front of the outer garment. Garment 10 can be donned easily as well by slipping the garment into place through the front of the outer garment and attaching the attachment devices as shown in FIGS. 5-7.

In some embodiments, garments of the invention can be reversible. For example, a second set of attachment devices can be added to the front side of the garment. Such can be positioned corresponding to the position of those in the back of the garment or can be positioned differently relative to those on the backside of the garment. The type of attachment device utilized on the front side of the device can be the same or can differ from those utilized on the backside.

Alternative attachment device type and placement can also allow reversibility of garments of the invention. For example, an attachment device on a tab or extension which extends from the garment and which is rotatable relative to the garment can be utilized for reversibility. A magnet-type device can be utilized for reversibility. A hook, clasp or alternative device attached to a swivel can alternatively be utilized to afford device rotatability allowing the garment to be reversible. Accordingly, for embodiments utilizing two differing fabrics, the garment can be fabricated to allow the garment to coordinate with multiple differing outer garments.

The article of clothing of the invention advantageously allows for strapless and backless covering of a cleavage area. The garment is quickly removable and re-attachable. The garment allows for the wearing of low cut fashions where they may otherwise be deemed inappropriate without contending with an extra set of straps or the bulk and uncomfortable feeling brought about by an extra layer of clothing.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A strapless garment to conceal cleavage to be worn across the breast area of a wearer, comprising:

a panel comprising a first layer of a first fabric and a second layer of a second fabric, the panel having a front face and an opposing back face;

a first upper side seam along a first side of the garment;

a first lower side seam along the first side of the garment;

a first outermost corner disposed at a junction between the first upper side seam and the first lower side seam;

a second upper side seam along a second side of the garment;

a second lower side seam along the second side of the garment;

a second outermost corner disposed at a junction between the second upper side seam and the second lower side seam; and at least six attachment devices attached to the garment; a first of the attachment devices being disposed proximate the first outermost corner and a second of the attachment devices being disposed proximate the second outermost corner, the first and second attachment devices being configured to attach the panel to an article of clothing of a wearer or to the wearer's skin along side the wearer's breasts.

2. The garment of claim 1 wherein the first and second upper seams are equivalent in length relative to one another.

3. The garment of claim 1 wherein the first and second lower seams are equivalent in length relative to one another.

4. The garment of claim 1 wherein the first and second upper seams are shorter than the first and second lower seams.

5. The garment of claim 1 wherein the first and second fabrics differ from one another.

6. The garment of claim 5 wherein the garment is reversible by wearing the front face toward the wearer or wearing the back face toward the wearer.

7. The garment of claim 1 wherein the first fabric is stretchable in at least one direction.

8. The garment of claim 7 wherein the first fabric is stretchable in two directions.

9. A strapless and backless article of clothing to be worn over a wearer's breast area, comprising:

a fabric panel having a top, a bottom, a left side, a right side, a front face and a back face;

six seams consisting of a top seam, a bottom seam, two left side seams and two right side seams;

six corners, each of the corners being disposed at a junction between two of the six seams the six corners consisting of four inner corners and two outermost corners, a first outermost corner being disposed at a junction between the two left side seams and a second outermost corner being disposed at a junction between the two right side seams; and at least six attachment devices attached on the back face of the garment, each of the attachment devices being configured to attach to a wearer's bra, the bottom seam being disposed along a bottom front edge of the wearer's bra, at least two of the attachment devices being disposed along the bottom seam and configured to attach to the bottom edge of the bra.

10. The article of clothing of claim 9 wherein the article consists of a single panel.

11. The article of clothing of claim 9 wherein the panel consists of a single layer of fabric.

12. The article of clothing of claim 9 wherein the panel consists of a double layer of fabric.

13. The article of clothing of claim 9 wherein the attachment devices are selected from the group consisting of hooks, hook and loop fastener material, clips, clasps, snaps, magnets, adhesives, elastics, sewn, and buttons.

14. The article of clothing of claim 9 wherein the panel comprises elastic disposed along at least some of the side seams, the elastic comprising at least one of elastic strips and elastic thread and being incorporated into the seam at the time of sewing.

15. A garment worn over a wearer's breast area, consisting of:

a front layer of fabric disposed on a front side;

a back layer of fabric disposed on a back side;

a top seam joining the front and back layers of fabric along a top edge;

a bottom seam joining the front and back layers of fabric along a bottom edge;

a first upper side seam joining the front and back layers of fabric along an upper portion of a first side edge;

a first lower side seam joining the front and back layers of fabric along a lower portion of the first side edge;

a second upper side seam joining the front and back layers of fabric along an upper portion of a second side edge;

a second lower side seam joining the front and back layers of fabric along a lower portion of the second side edge;

six corners; a first corner being disposed at a junction between the top seam and the first upper side seam, a second corner being disposed at a junction between the top seam and the second upper side seam, a third corner being disposed at a junction between the first upper and first lower side seams, a fourth corner being disposed at a junction between the second upper and second lower side seams, a fifth corner being disposed at a junction between the bottom seam and the first lower side seam and a sixth corner being disposed at a junction between the bottom seam and the second lower side seam; and six attachment devices disposed individually at each of the six corners and configured to attach across the chest to an undergarment of a wearer or to a wearer's skin, the garment being strapless and backless, the bottom edge of the garment being disposed (just beneath the wearer's breasts.

16. The garment of claim 15 wherein the upper seam is curved downward, away from the wearer's neck.

17. The garment of claim 15 wherein the first and second lower side seams have elastic incorporated therein, the elastic being incorporated either by sewing an elastic strip into each of the first and second lower side seams or by utilizing elastic thread for sewing the first and second lower side seams.

18. The garment of claim 15 wherein the attachment devices are selected from the group consisting of hooks, hook and loop fastener material, clips, clasps, snaps, magnets, adhesives, elastics, sewn, and buttons.

19. The garment of claim 15 wherein the third and fourth corners are spaced apart from one another laterally by a greater distance than are the first and second corners.

20. The garment of claim 19 wherein the attachment devices attached at the third and fourth corners attach the garment to the top of each of two side straps on the wearer's bra.

21. The garment of claim 15 wherein the attachment devices attached at the fifth and sixth corners attach the garment to the bottom of a wearer's bra.

22. The garment of claim 15 wherein the garment is reversible.

* * * * *

UNITED STATES PATENT AND TRADEMARK OFFICE

CERTIFICATE OF CORRECTION

PATENT NO. : 7,520,794 B1
APPLICATION NO. : 12/038436
DATED : April 21, 2009
INVENTOR(S) : Johnson It is certified that error appears in the above-identified patent and that said Letters Patent is hereby corrected as shown below:

On the title page item (57) Abstract, Line 4 – Replace “side seem” with --side seam--.

Column 1, Line 45 – Replace “side seem” with --side seam--.

Column 2, Line 59 – Replace “is show” with --is shown--.

Column 3, Line 52 – Replace “providing a” with --providing an--.

Column 7, Line 19 – Replace “(just beneath” with --just beneath--.

Signed and Sealed this

Twenty-third Day of June, 2009

John Doll

JOHN DOLL
*Acting Director of the United States Patent and Trademark Office*